US007210177B1

(12) United States Patent
John

(10) Patent No.: US 7,210,177 B1
(45) Date of Patent: May 1, 2007

(54) CONVERTIBLE BEACH TOWEL BAG WITH FANNY PACK STRAP

(76) Inventor: Ricardo John, 136 Roswell Ave., Staten Island, NY (US) 10314

( * ) Notice: Subject to any disclaimer, the term of this patent is extended or adjusted under 35 U.S.C. 154(b) by 0 days.

(21) Appl. No.: 11/282,975

(22) Filed: Nov. 18, 2005

(51) Int. Cl.
*A47G 9/06* (2006.01)
*A45F 3/00* (2006.01)

(52) U.S. Cl. ..... 5/417; 5/485; 383/4

(58) Field of Classification Search ..... 5/413 R, 5/417, 485, 486, 496; 383/4
See application file for complete search history.

(56) References Cited

U.S. PATENT DOCUMENTS 4,604,765 A * 8/1986 Schultz ..... 5/413 AM
5,103,515 A * 4/1992 Bird ..... 5/420
5,774,912 A * 7/1998 Dominique ..... 5/419
5,918,332 A * 7/1999 Dees ..... 5/639
6,367,083 B1 * 4/2002 November ..... 2/69.5
6,751,816 B1 * 6/2004 Wechsler ..... 5/417

* cited by examiner

*Primary Examiner*—Michael Trettel
(74) *Attorney, Agent, or Firm*—Goldstein Law Offices P.C.

(57) ABSTRACT

A convertible towel, for use by a user having a shoulder and a waist. The convertible towel includes a towel portion and a shoulder strap. The towel portion is selectively folded longitudinally and maintained in that once folded position by a zipper, then folded transversely and maintained in that twice folded position by secondary fasteners, and then folded transversely and maintained in that thrice folded position by primary fasteners. The thrice-folded towel portion is in a compact rectangular form that is then connected to the shoulder strap so that it can be carried by the user in a hands-free manner. In the compact rectangular form, multiple storage compartments are provided that are selectively accessible by the zipper. The shoulder strap preferably includes a fanny pack for containing personal items, such that the shoulder strap may be detached from the towel portion and extended around the waist of the user.

4 Claims, 4 Drawing Sheets

CONVERTIBLE BEACH TOWEL BAG WITH FANNY PACK STRAP

BACKGROUND OF THE INVENTION

The invention relates to a convertible beach towel and tote bag. More particularly, the invention relates to a beach towel that folds into a compact form and provides multiple storage compartments therein. When combined with the included fanny pack strap, the tote bag is easily carried.

When traveling to the beach, one must often carry a variety of items. In addition to sun tan lotion, personal items such as a wallet and keys, and a towel, often it is desirable to bring a radio and a beverage cooler. It is difficult to carry all of these items simultaneously. Especially when carrying a cooler, it would be highly desirable to also have the ability to easily carry personal items.

Another difficulty commonly encountered at the beach is preventing lost keys, wallets, and other personal items. When placed on the sand, small items easily disappear—never to be seen again. It is a common practice to place items at the bottom of the 'beach bag'. Unfortunately, when one removes larger items—such as a towel—from the bag, the smaller items can easily spill out and get lost.

Currently available are a myriad of tote bags of various designs, devices that simplify the carrying of a beach chair and/or umbrella, and devices that facilitate bringing valuables into the water in a water-proof container.

While these units may be suitable for the particular purpose employed, or for general use, they would not be as suitable for the purposes of the present invention as disclosed hereafter.

SUMMARY OF THE INVENTION

It is an object of the invention to produce a convertible beach towel that folds compactly for easy transport. Accordingly, the towel folds in longitudinally half and neatly zippers using a zipper that continuously follows its outer edge. Further, the towel the folds transversely in half and secures to itself, and transversely in half again, securing to itself in a compact rectangular form.

It is another object of the invention to provide a convertible beach towel bag that provides multiple storage compartments. Accordingly, when the towel is folded, at least one storage compartment is formed and enclosed by the zipper. When the towel is folded again the storage compartment is effectively partitioned, wherein access is selectively provided to either portion by the zipper.

It is yet another object of the invention to provide a convertible beach towel that is easily carried. Accordingly, a shoulder strap attaches at both ends to the compact rectangular form, whereby the strap extends over the shoulder as the compact rectangular form is supported therebeneath—allowing the use to carry the towel "hands-free".

It is a further object of the invention to provide a convertible beach towel that provides a secure location for personal items. Accordingly, the shoulder strap includes a fanny pack that is sized to contain needed personal items. The fanny pack extends over the shoulder when the towel is being carried, and then detaches from the rectangular form so that it can be attached around the waist of the user.

The invention is a convertible towel, for use by a user having a shoulder and a waist. The convertible towel includes a towel portion and a shoulder strap. The towel portion is selectively folded longitudinally and maintained in that once folded position by a zipper, then folded transversely and maintained in that twice folded position by secondary fasteners, and then folded transversely and maintained in that thrice folded position by primary fasteners. The thrice-folded towel portion is in a compact rectangular form that is then connected to the shoulder strap so that it can be carried by the user in a hands-free manner. In the compact rectangular form, multiple storage compartments are provided that are selectively accessible by the zipper. The shoulder strap preferably includes a fanny pack for containing personal items, such that the shoulder strap may be detached from the towel portion and extended around the waist of the user.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
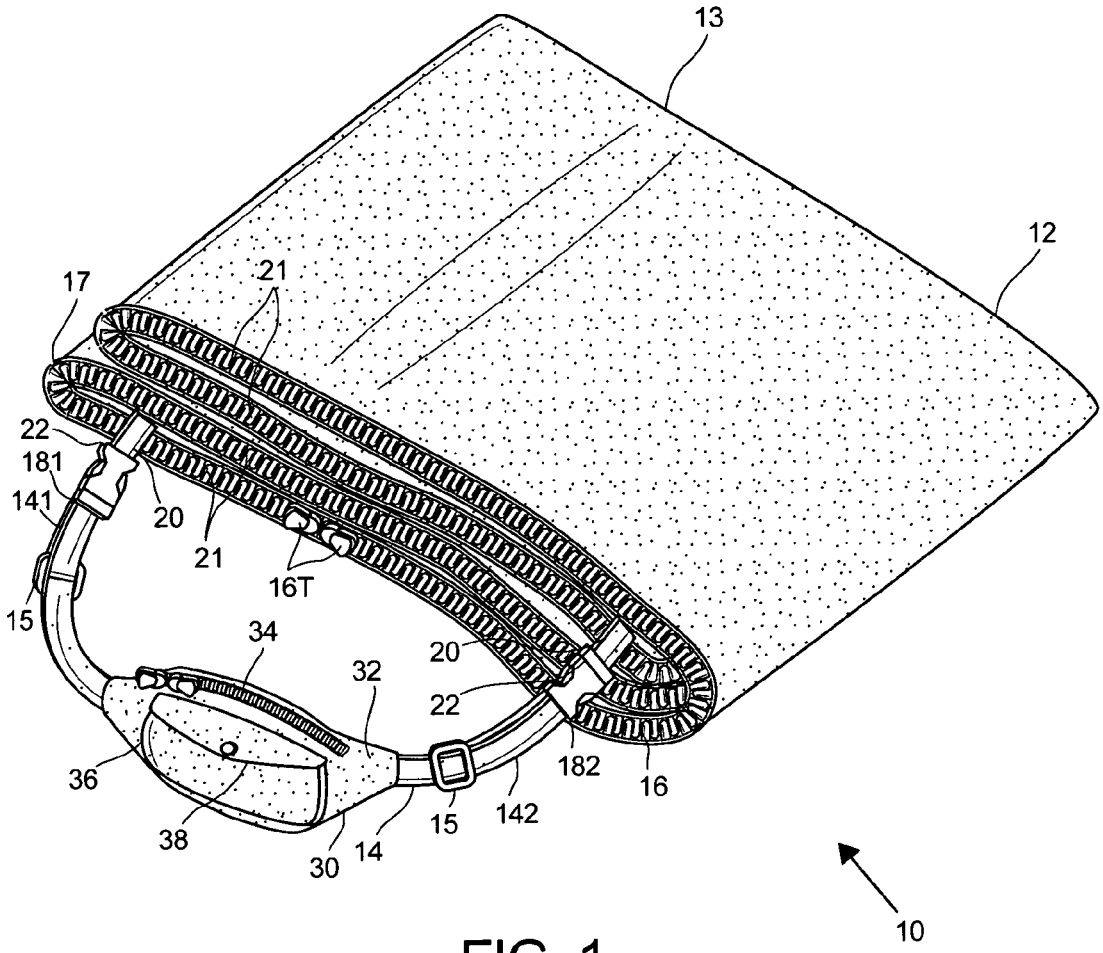
FIG. 1 is a diagrammatic perspective view, illustrating the invention, per se, wherein the towel is folded into its compact rectangular form, and wherein the fanny pack and shoulder strap are attached to the compact rectangular form.

FIG. 1 illustrates a convertible beach towel 10, comprising a towel portion 12, and a shoulder strap assembly 14. The towel portion 12 is illustrated in a compact rectangular form, wherein the towel portion 12 has been folded once along a longitudinal fold line 13 and secured along its edges with a zipper 16, and then has been folded twice more transversely. This may be referred to as a thrice-folded position of the towel portion 12. A longitudinal zippered edge 17 is seen in this view as well. In this compact rectangular form, four storage compartments 21 are effectively created—being partitioned by the folds in the towel portion, which are accessible by a pair of traveling zipper tabs 16T. The traveling zipper tabs 16T can be moved together (as a unit) around the zipper 16 midway on the desired compartment 21, and then separated somewhat to create access to that compartment 21, and allow items to be inserted thereinto.

The shoulder strap assembly 14 includes a first end 141 and a second end 142. A first coupler 181 is present at the first end 141 and a second coupler 182 is present at the second end 142. The towel portion 12 has a pair of connecting straps 20 that each has a connecting coupler 22. The connecting couplers 22 mate with the first coupler 181 and second coupler 182 so that the shoulder strap assembly 14 can extend over the shoulder of a user, whereby the towel portion 12 is suspended beneath the armpit of the user for hands-free carrying. The shoulder strap assembly 14 may be adjusted in length by using a pair of adjustment buckles 15 which may be configured to allow the shortening and lengthening of the shoulder strap assembly 14 in a conventional way.

The shoulder strap 14 also includes a fanny pack 30 substantially midway between the first end 141 and second end 142. The fanny pack 30 preferably has a main pocket 32, to which access is provided with a main pocket zipper 34; and a front pocket 36. The front pocket 36 has a flap 38 that is selectively closeable to selectively allow access to the front pocket 36 and hold personal items securely therein. When the convertible towel 10 is being carried, the fanny pack 30 extends directly over the shoulder of the user.

Figure 2:
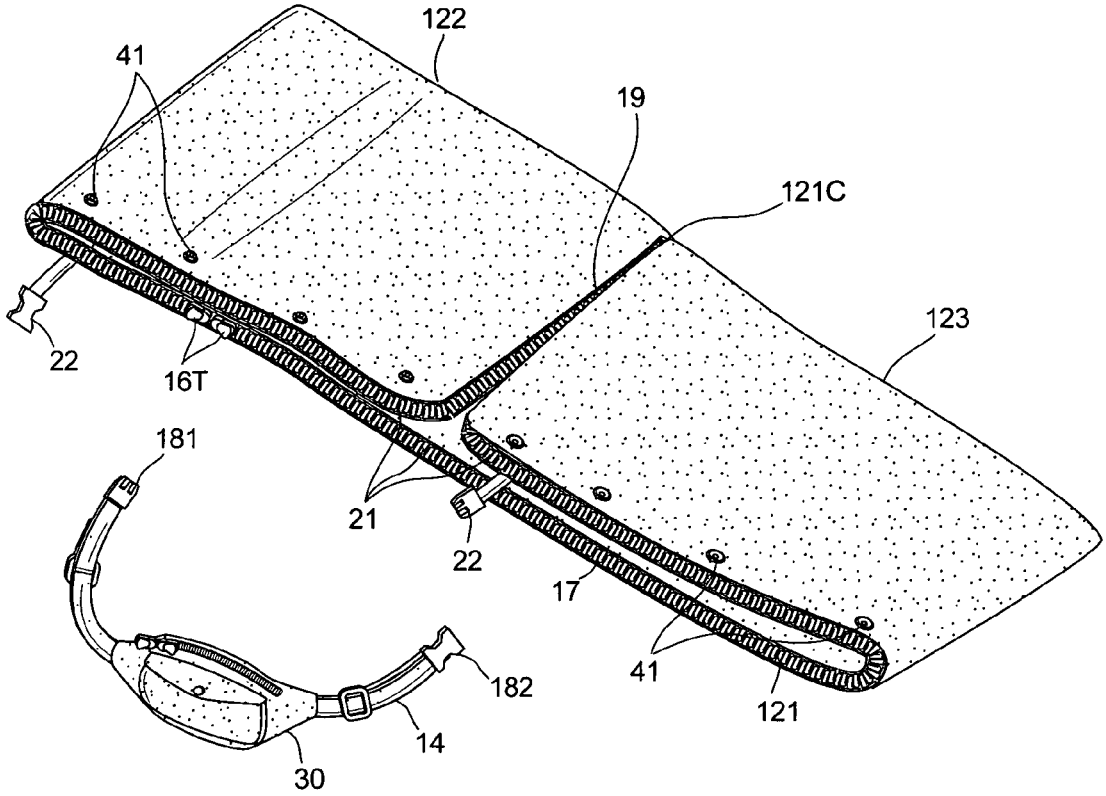
FIG. 2 is a diagrammatic perspective view, wherein the fanny pack and shoulder strap have been detached from the towel, and wherein the towel has been partially unfolded to reveal fasteners that are used to maintain the towel in its compact rectangular form.

In FIG. 2, the shoulder strap 14 has been detached from the towel portion 12 by detaching the first coupler 181 and second coupler 182 from the connecting couplers 22. It should be noted that the first coupler 181 is male, while the second coupler 182 is female. Accordingly, the shoulder strap 14 can now be secured around the waist of the user by fastening the first coupler 181 and second coupler. Accordingly, the fanny pack 30 incorporated with the shoulder strap 14 can be worn around the waist of the user in manner conventionally associated with fanny packs.

Further illustrated in FIG. 2, the towel portion 12 has been unfolded once into a twice folded position, revealing a primary group of fasteners 41 which secure the towel portion in the thrice folded position, and a transverse zippered edge 19 extending substantially perpendicular to the longitudinal zippered edge 17. At this point, it can be said that the towel portion 12 has a main portion 121, and a couple of flap portion 122, 123 that are substantially half the longitudinal length of the main portion 121, and abut each other along a center edge 121C. The main portion 121 thereby forms one large storage compartment 21 and the flap portions 122, 123 form two smaller storage compartments that are each accessible by moving the traveling zipper tabs 16T.

The primary group of fasteners 41 extend parallel to and near the longitudinal zippered edge 17. The primary group of fasteners 41 are preferably snap fasteners that are positioned in equal amounts on each of the flap portions 122, 123, and are substantially symmetrical in location and complementary in type about the center edge 121C, to facilitate attaching the flap portions 122 together to form the towel portion into the thrice folded position of FIG. 1.

Figure 3:
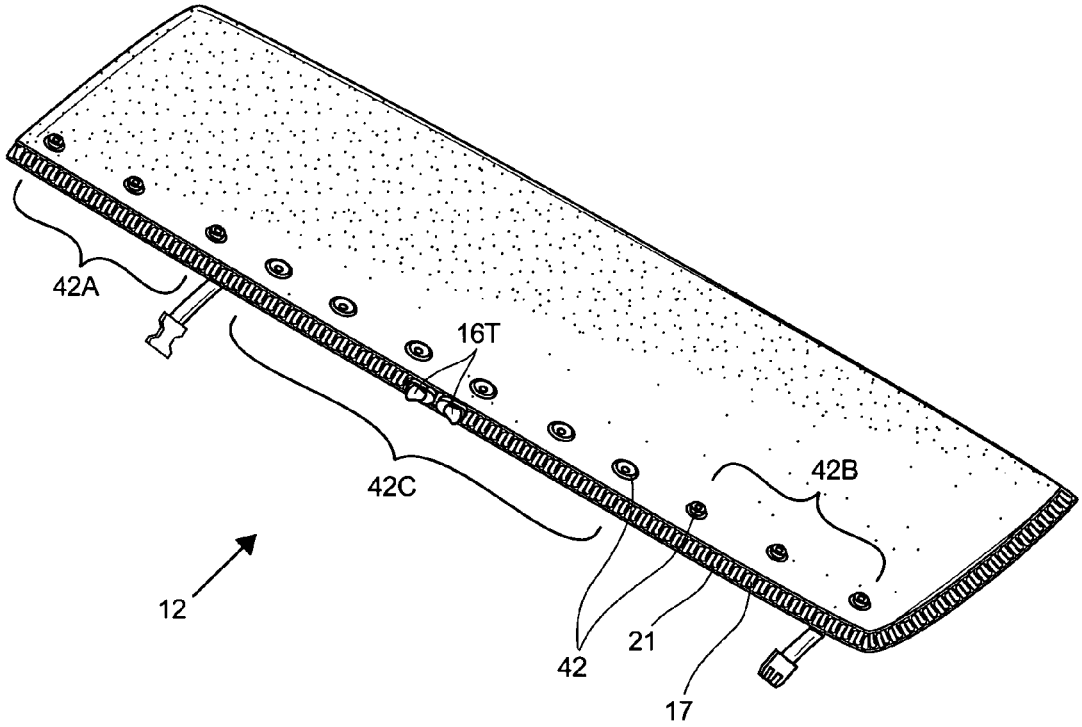
FIG. 3 is a diagrammatic perspective view of just the towel portion, similar to FIG. 2, except wherein the towel has been a unfolded once more, revealing further fastener.

In FIG. 3, the towel portion 12 has been unfolded once again into a once folded position, revealing a secondary group of fasteners 42 which are used to secure the towel portion 12 into the twice folded position of FIG. 2. In this once folded position, a single storage compartment 21 is defined by the zipper 16 and is selectively accessible by the traveling zipper tabs 16T. Also in FIG. 3, The secondary group of fasteners 42 are arranged in a row that extends parallel to and near the longitudinal zippered edge 17, and parallel to the longitudinal fold line 13. Note that in FIG. 3, the primary group of fasteners 41 cannot be seen—as they are now beneath the towel portion 12. It should be noted that the fasteners are arranged in a pair of outer zones 42A, 42B, and a central zone 42C located between the outer zones 42A, 42B. The central zone 42C fasteners are of a type that is capable of mating with the outer zone fasteners. In this illustration, these are snap fasteners of complementary type. Alternatively, the fasteners can be zippers that are arranged to join the primary fasteners together, and outer zones 42A, 42B with the central zone 42C.

Accordingly, referring momentarily and simultaneously to FIG. 2 and FIG. 3, when the towel portion 12 is folded transversely, it is folded between each of the outer zones 42A and the central zone 42C to create the flap portions 122, 123 which abut each other along the central edge and secure against the main portion 121 by securing the fasteners in the outer zones 42A to the fasteners in the central zone 42C.

Figure 4:
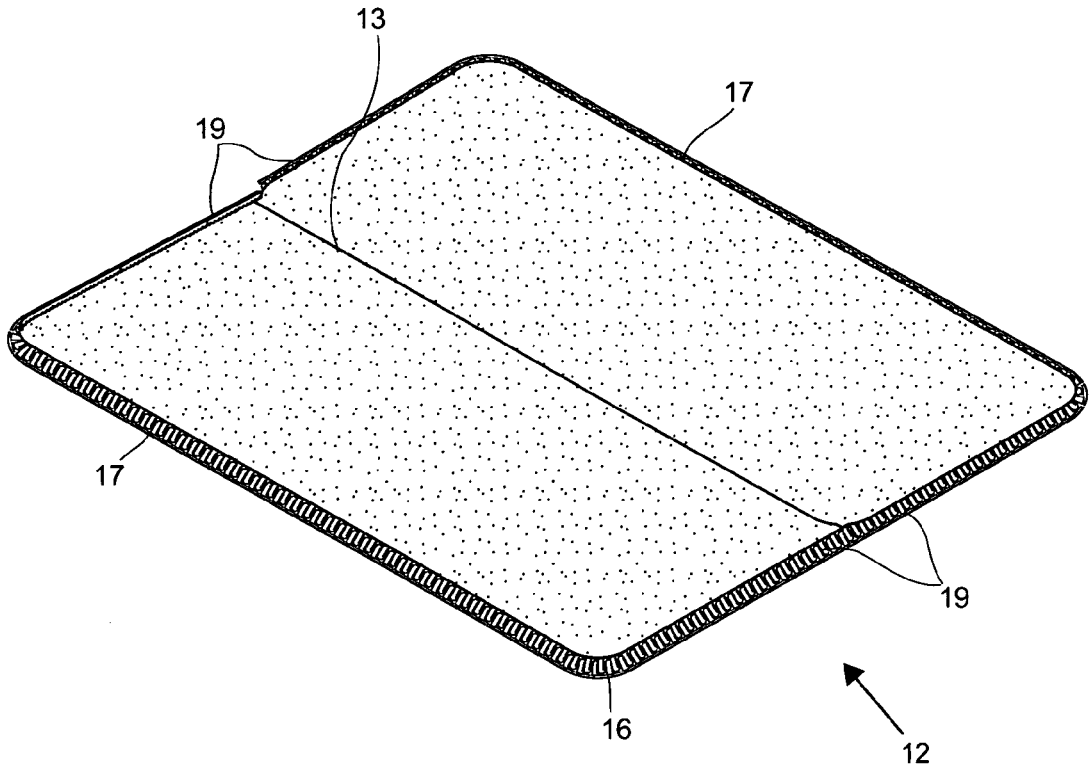
FIG. 4 is a diagrammatic perspective view, similar to FIG. 3, except wherein the towel has been fully un-zippered and unfolded along the fold line illustrated, the towel is now ready for use.

Referring now to FIG. 4, the towel portion 12 has been un-zippered along both the transverse zippered edges 19 and the longitudinal zippered edge 17, allowing the towel portion 12 to unfold along its longitudinal fold line 13 that extends substantially parallel to the longitudinal zippered edge 17 and substantially parallel to the transverse zippered edges 19. It is preferable that the zipper 16 be substantially continuous, so that the zippering and un-zippering can be carried out as a single operation when the user folds and unfolds the towel, for use and for storage. Note that the primary fasteners 41 and secondary fasteners 42 are not seen in this illustration, as they are now beneath the towel as shown.

It should be clear, then, to fold the towel on FIG. 4 for storage, one need simply operate the zipper 16 to join a pair of the transverse zippered edges 19, the longitudinal zippered edges 17, and then the other pair of transverse zippered edges 19, thereby naturally folding the towel portion 12 long the longitudinal fold line 13 to form the once folded position shown in FIG. 3. Then, the transverse zippered edges 19 are brought inwardly to abut each other along the center edge 121C by folding the towel portion transversely between the central fastener zone 42C and each of the outer fastener zones 42A, 42B to create the flap portion 121, 122, and then securing the flap portions 121, 122 to the main portion by securing the fasteners of the outer fastener zone 42A with the fasteners of the central fastener zone 42C to create the twice folded position of FIG. 2. Then, the towel portion 12 is folded about the central edge 121C to mate the flap portions 121, 122 together by mating the primary fasteners 41 together to form the thrice-folded position—also known as a compact rectangular form. To carry the towel portion 12, the shoulder strap 14 is mated to the towel portion 12 by mating the first connection 181 and second connector 182 with the connecting couplers 22 of the towel portion 12.

In conclusion, herein is presented a convertible towel that is easy to carry and allows the user to carry personal items in a hands-free manner. The invention is illustrated by example in the drawing figures, and throughout the written description. It should be understood that numerous variations are possible, while adhering to the inventive concept. Such variations are contemplated as being a part of the present invention.

What is claimed is:

1. A convertible towel, for use by a user having a shoulder and a waist, comprising:

a towel portion having a longitudinal fold line, a zipper including two pairs of transverse zippered edges and a pair of longitudinal zippered edges, the zippered edges of each pair of transverse zippered edges are selectively brought together and the longitudinal zippered edges are selectively brought together to fold the towel portion along the longitudinal fold line to create a once folded position, and fasteners that allow the towel portion in the once folded position to be folded transversely into a compact rectangular form; and a shoulder strap that selectively mates with the towel portion in its compact rectangular form, extends over the shoulder of the user, and suspends the towel portion beneath the shoulder of the user, wherein the shoulder strap has a first end and a second end, and wherein the shoulder strap has a fanny pack located substantially midway between the first end and second end, such that the shoulder strap may be extended around the waist of the user to hold the fanny pack at the waist of the user.

2. The convertible towel as recited in claim 1, wherein the shoulder strap has a first connecter at its first end and a second connector at its second end; the towel portion has a pair of connector straps each having a connecting coupler; wherein the connecting couplers selectively mate with the first connector and second connector; and wherein the first connector is male and the second connector is female so that the first connector can be fastened to the second connector when not attached to the connecting couplers on the connecting straps.

3. The convertible towel as recited in claim 2, wherein the towel portion has secondary fasteners extending parallel to and near the longitudinal zippered edge, the secondary fasteners including a central fastener zone, and a pair of outer fastener zones; wherein the towel is selectively folded transversely between each of the outer fastener zones and the central zone to create a main portion and a pair of flaps from the towel portion; and wherein the towel is selectively fastened into a twice folded position by securing the fasteners of the outer fastener zones to the fasteners of the central fastener zone.

4. The convertible towel as recited in claim 3, wherein the towel portion has primary fasteners extending parallel to and near the longitudinal zippered edge on each of the flaps, the primary fasteners selectively securing to each other as the towel portion is folded transversely into a thrice-folded position.

* * * * *